US005345655A

United States Patent [19]

Bernhardt

[11] Patent Number: 5,345,655

[45] Date of Patent: Sep. 13, 1994

[54] METHOD OF AND ARRANGEMENT FOR OBTAINING LIQUIDS AND/OR GASES FROM GROUND OR ROCK LAYERS

[75] Inventor: Bruno Bernhardt, Reutlingen, Fed. Rep. of Germany

[73] Assignee: IEG Industrie-Engineering GmbH, Reutlingen, Fed. Rep. of Germany

[21] Appl. No.: 305,034

[22] Filed: Feb. 5, 1993

[30] Foreign Application Priority Data

Feb. 19, 1992 [DE] Fed. Rep. of Germany ..... 4204990

[51] Int. Cl.[5] ..... E21B 43/00

[52] U.S. Cl. ..... 166/370; 166/72; 210/170

[58] Field of Search ..... 166/67, 105.5, 265, 166/266, 311, 370, 372; 210/170

[56] References Cited

U.S. PATENT DOCUMENTS

| | | | |
|---|---|---|---|
| 2,986,215 | 5/1961 | Barr | 166/67 |
| 4,131,161 | 12/1978 | Lacquement | 166/265 |
| 4,478,765 | 10/1984 | Tubbs | 217/170 X |
| 4,497,370 | 2/1985 | Breslin | 166/74 X |
| 4,518,038 | 5/1985 | Maddox, Jr. et al. . | |
| 4,678,040 | 7/1987 | McLaughlin et al. | 166/370 |
| 4,761,225 | 8/1988 | Breslin | 166/265 X |
| 4,766,957 | 8/1988 | McIntyre | 166/265 |
| 4,950,394 | 8/1990 | Bernhardt et al. | 210/170 |
| 5,095,975 | 3/1992 | Bernhardt . | |
| 5,104,554 | 4/1992 | Dempsey | 210/170 X |
| 5,143,606 | 9/1992 | Bernhardt . | |
| 5,143,607 | 9/1992 | Bernhardt | 210/170 |
| 5,171,103 | 12/1992 | Bernhardt | 210/170 X |
| 5,171,104 | 12/1992 | Bernhardt . | |

OTHER PUBLICATIONS

Brunnenbau, Bau von Wasserwerken, Rohrleitungsbau, Arthur Golwer & Oskar Post, 1978, pp. 360–363.

*Primary Examiner*—Ramon S. Britts
*Assistant Examiner*—Frank S. Tsay
*Attorney, Agent, or Firm*—Michael J. Striker

[57] ABSTRACT

For obtaining liquids and/or gases contained in ground or rock formation, contaminants or useful substances, especially oils, at least one shaft is arranged in a corresponding region, a negative pressure is formed in the shaft provided with a casing having vertically spaced permeable and impermeable wall portions so as to produce a circulation of an available or introduced liquid from ground or rock formations through a first permeable wall region into the shaft, further in an axial direction of the shaft, and then through a second permeable wall region back into the ground or rock formations, gases entrained in the circulation of liquids are separated from the liquid by a negative pressure device, and a second shaft is arranged near the first mentioned shaft so that the circulations of liquid in the shafts touch or intersect one another.

28 Claims, 5 Drawing Sheets

METHOD OF AND ARRANGEMENT FOR OBTAINING LIQUIDS AND/OR GASES FROM GROUND OR ROCK LAYERS

BACKGROUND OF THE INVENTION

The present invention relates to a method for obtaining from liquids and/or gases, both the contaminants or useful substances particularly oil, after forming at least one shaft or bore hole in this region, and also to an arrangement for performing the method.

The known methods for obtaining oil residues from ground or rock formations, also for obtaining oil residues from depleted oil strata have the disadvantage that with the utilized rinsing process, substantial lowering of the ground water layer in ground due to pumping out of introduced rinsing liquid can occur with the resulting damages to the outer surfaces. Moreover, a substantial differential pressure is produced in the ground layers and causes the undesired changes in the ground which negatively affect the efficiency of the process.

SUMMARY OF THE INVENTION

Accordingly, it is an object of the present invention to provide a method of and an arrangement for obtaining liquids and/or gases contained in ground and rock formations with which oil containing residues from ground or rock formations with and without gas fractions can be removed with low energy consumption and with a remarkable efficiency.

In keeping with these objects and with others which will become apparent hereinafter, one feature of the present invention resides, briefly stated, in a method which has the following steps:

forming a negative pressure in a shaft or bore hole provided with a coating having spaced permeable and impermeable wall regions, and thereby producing a circulation of an available or introduced liquid from ground or rock formations through a first permeable wall region into the shaft, in an axial direction of the shaft further and through a second permeable wall region again into the ground or rock formations back; and aspirating gases entrained in the circulation of liquid by a negative pressure device of the shaft and/or from a liquid separated in the shaft such as for example oil by means of liquid probes through a filter or another separator outwardly.

The important advantage of the method in accordance with the present invention is that it is performed with continuous maintaining and available ground water level and avoids great pressure difference in the underground to be treated which negatively influences the efficiency. Therefore the energy utilization is substantially required only for overcoming flow resistances during continuous equilibrium conditions and thereby achievable turbulence free laminar flows as well as pumping out of obtaining oil or other liquids and/or gases. The method in accordance with the present invention and the arrangement used for it contribute to and facilitate a phase formation of the liquid or gas parts to be recovered and thereby their separation from a carrier liquid.

Experiments have shown that during the production of a circulation of the available or introduced carrier liquid through the ground or rock formations to be treated under the action of negative pressure in the formations, the gas bubbles which raise in the shaft contribute to the separation of the recovered liquid fraction and the oil part can deposit on the gas bubbles and transported with them.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
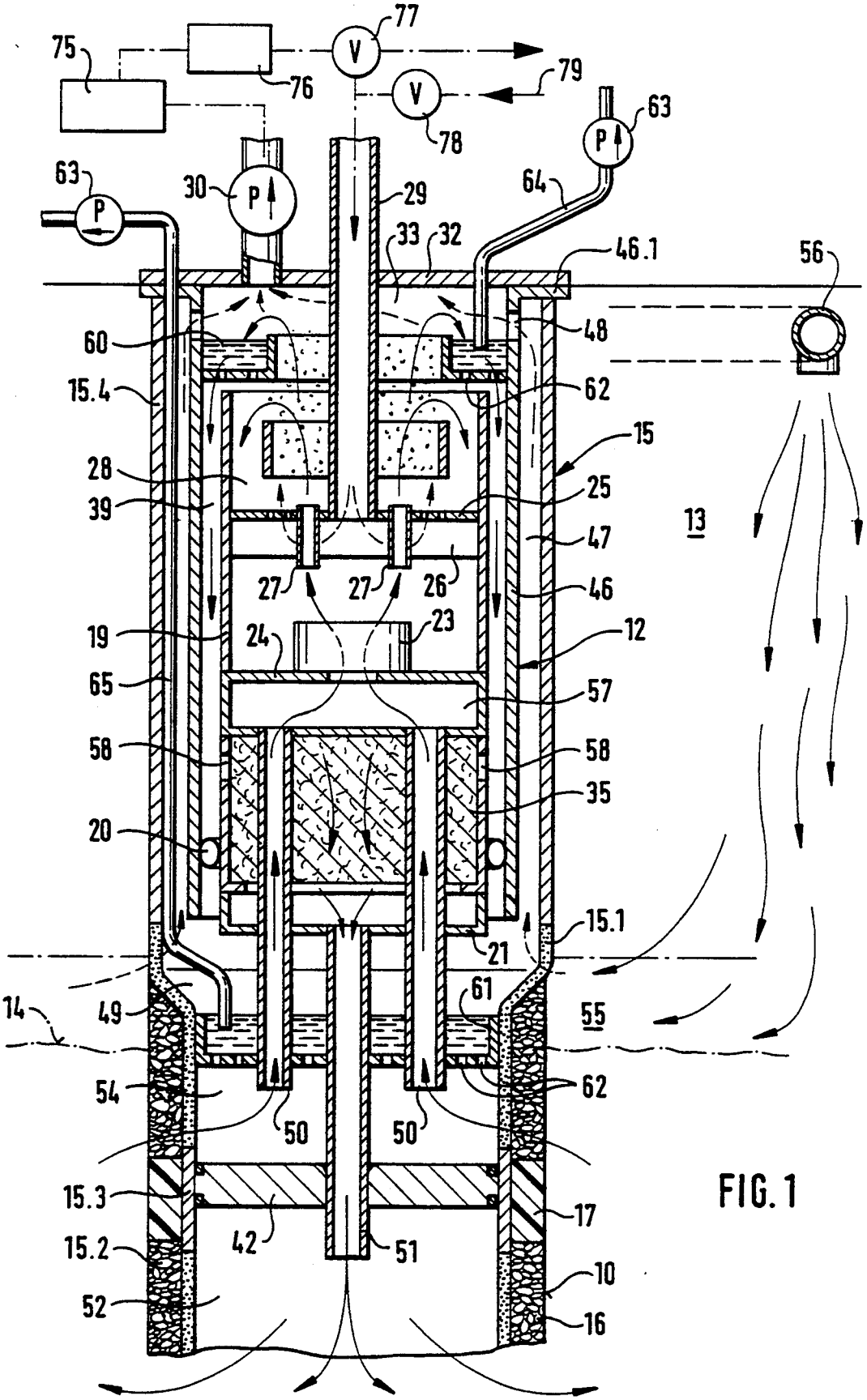
FIGS. 1–3 are schematic longitudinal sections through an upper part of a bore shaft provided with a shaft insert in accordance with different embodiments of the shaft inserts.
Figure 2:
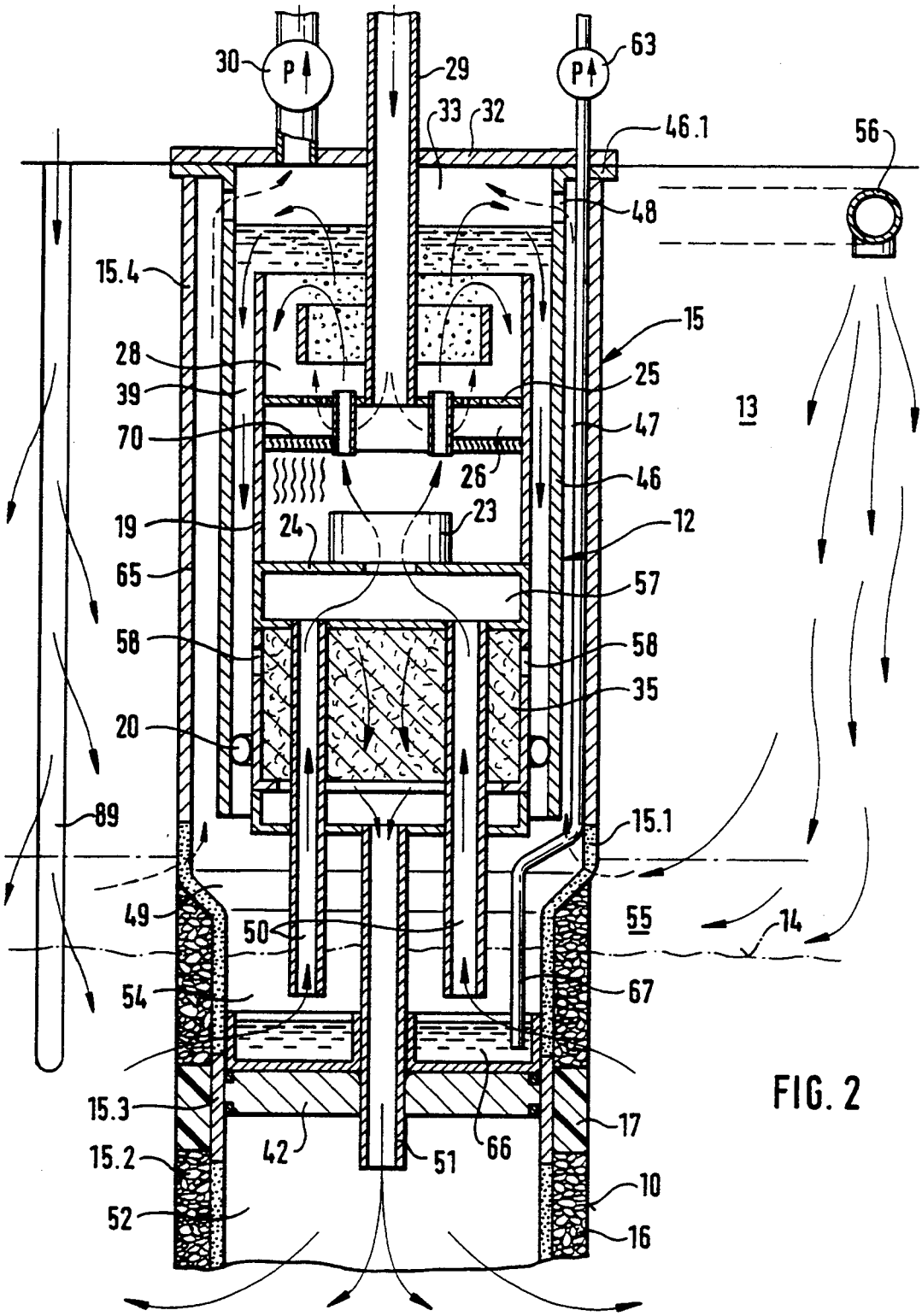
Figure 3:
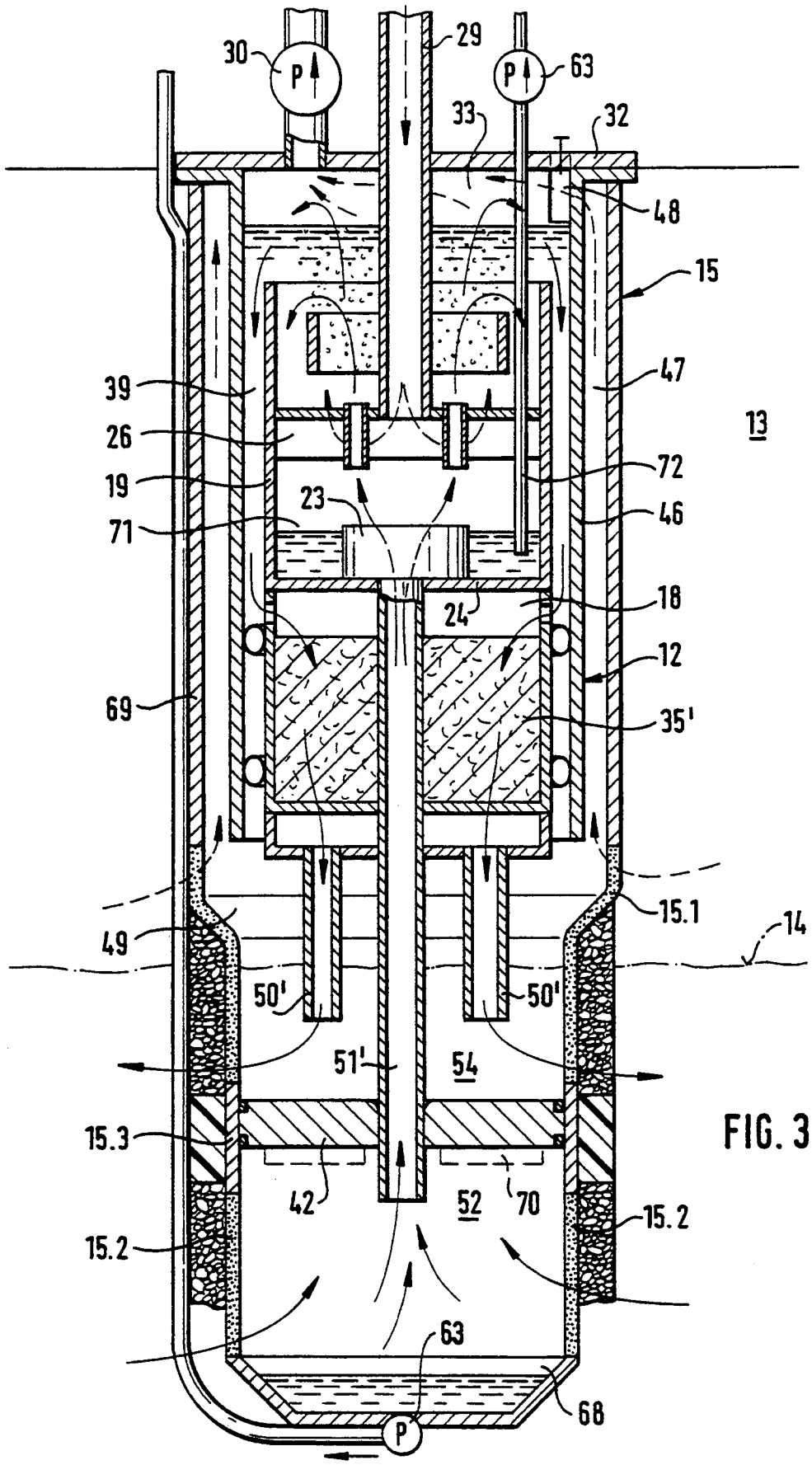
Figure 4:
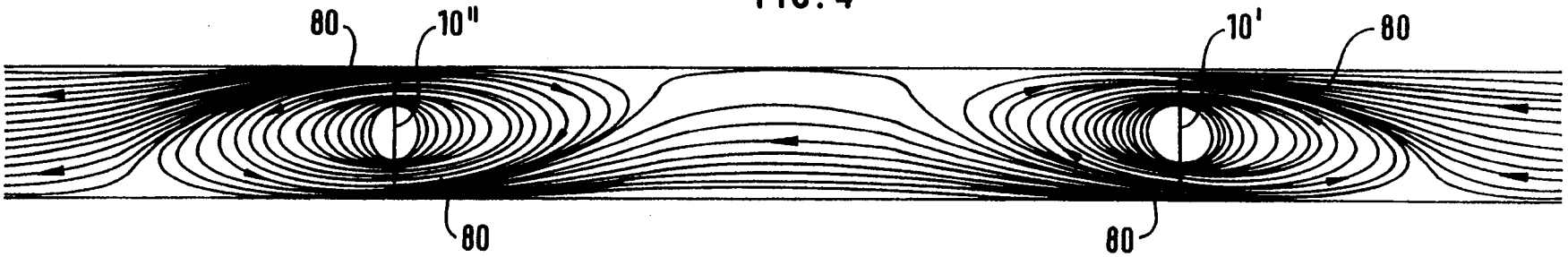
FIGS. 4–9 are computed-produced flow diagrams during cooperation of neighboring bore shafts in flowing ground water.
Figure 5:
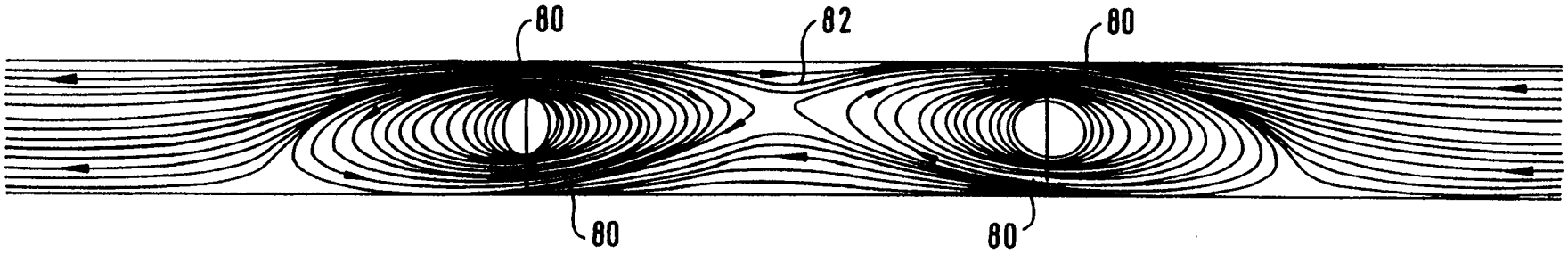
Figure 6:
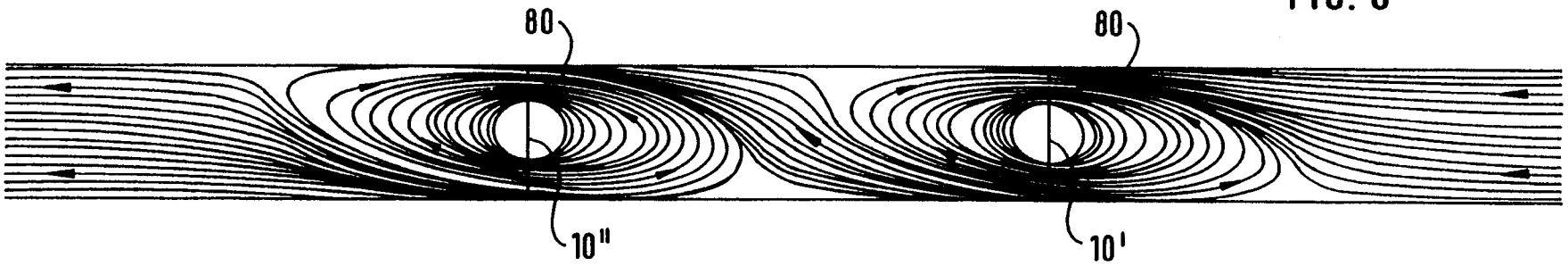
Figure 7:
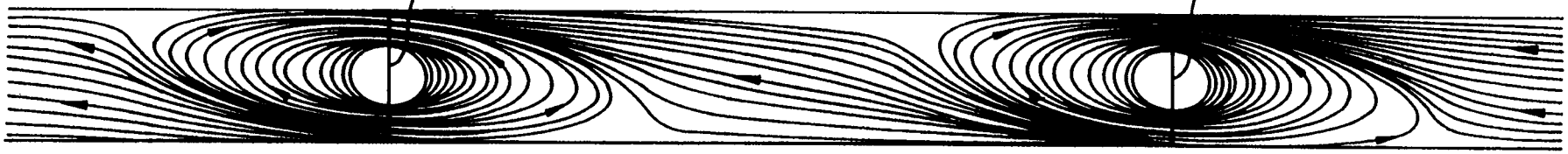

In the embodiments shown in FIGS. 1–3 identical parts are identified with same reference numerals. All Figures show a circular cylindrical bore shaft provided with a wall 10 and extending in a contaminated ground region 13 over an available ground water level 14. The shaft is cased at least in its shown upper part with a tubular body 15 having wall regions which are permeable and impermeable for liquids and gases. An upper impermeable wall region 15.4 is connected with a first permeable wall region 15.1. A second permeable tubular wall region 15.2 is separated from the first permeable wall region 15.1 by an impermeable wall region 15.3. The wall of the tubular body extends from the first permeable wall region 15.1 at a distance from the shaft wall 10, and an intermediate space with respect to the shaft wall 10 is retained fluid permeable with a gravel filling 16. A sealing mass 17 is filled at the height of the impermeable wall region 15.3 in the intermediate space between the tubular body 15 and the shaft wall 10. The tubular body 15 and thereby the shaft are closed by a cover 32.

A shaft insert 12 is arranged in the tubular body 15. It is composed of a casing tube 46 with an upper mounting flange 46.1. A hollow cylindrical body 19 is inserted coaxially in the casing tube and held by inflatable sealing packers 20 on the casing tube 46. The hollow cylindrical body 19 is closed in its lower end by a bottom wall 21. The bottom wall has a central throughgoing opening for a liquid pipe 51 extending downwardly and also has openings for connecting tubes 50. Electrically operating circulating pump 23 is arranged before a central opening of a central wall 24 of the hollow cylindrical body 19. A nozzle body 26 with an upper nozzle wall 25 is formed in the upper part of the upwardly open hollow cylinder body 19. The nozzle body 26 which is provided with the throughgoing tubes 27 is supplied with air or another gas through a central gas supply pipe 29 extending through an opening in the cover 32 from outside. The air or gas supplied under the action of a negative pressure in the upper shaft insert body and generated by a fan 30 mounted on the cover. It raises through the nozzle wall 25 in form of bubbles upwardly through a loading region 28 of the shaft insert.

The liquid tube which extends from the bottom wall 21 of the hollow cylindrical body 19 downwardly passes tightly through a separation wall 42 which is tightly inserted in the region of the impermeable wall region 15.3 in the tubular body 15. It forms a liquid-tight separation between the tubular body region 54 provided with the first permeable wall region 15.1 and the tubular body region 52 provided with the second permeable wall region 15.2.

A filter body 35 is inserted in the region of the hollow cylindrical body 19 which is limited by the bottom wall 21 and the central wall 24 from below and above. Connecting pipes 15 extend through the filter body 35. Openings are provided in the outer wall of the hollow cylindrical body 19 in the region of the filter body 35. They connect the ring chambers 39 formed within the casing tube 46 and the outer wall of the hollow cylindrical body 19, with the filter chamber. The ring chamber 47 formed between the impermeable wall region 15.4 of the tubular body 15 and the casing tube 46 is open downwardly and connected upwardly through openings 48 in the casing tube 46 with the upper shaft end which forms a gas collecting chamber 33.

The used air or another gas can be guided in all embodiments completely or partially in a circulation as shown in FIG. 1. The gas aspirated by the fan 30 can be supplied through a heating or cooling aggregate 75 and subsequently through a gas filter 76. A part of or the complete gas stream can be supplied back into the gas guiding tube 29 at a multiway valve 77 or an adjustable throttle with branching. A branching conduit provided with a check valve 78 can selectively supply an additional gas.

In the embodiments of FIGS. 1 and 2 a ring conduit 56 is located around the shaft with a distance from it. Through the ring conduit 56 liquid can be supplied into the ground region 13 for cleaning a capillary region 55 located above the ground water level 14. FIG. 2 shows a pressure unloading opening 79 through which liquid can be supplied as well. The liquid which is supplied from the tubular body region 64 through the permeable wall region 15.1 can be aspirated by the circulating pump 23 through the connecting tube 50 and supplied by the tube 27 through the nozzle body 26 into the upper loading region 28 of the shaft insert 12. In the loading region 28 the gas which discharges from the nozzle body 26 passes through the upwardly transported liquid. The upwardly transported liquid flows from the upper free opening of the hollow cylinder body 19 is supplied to the ring chamber 39 and flows through the ring chamber downwardly and through the openings 58 in the filter body 35, and finally passes in the liquid tube 51 through the separating wall 42 into the tubular body region 52 which is limited by the second permeable wall region 15.2. From there the liquid an flow out again from the shaft as identified with the arrow.

In the arrangement of FIG. 3 in deviation from the arrangement of FIGS. 1 and 2, there is no ring conduit 56. A liquid inlet is provided in the shaft inserts 15 through the permeable wall region 15.2, while the liquid outlet from the shaft is performed through the permeable wall region 15.5, or in other words contrary to the arrangements in FIGS. 1 and 2. Correspondingly, connecting tubes 50' are provided, which extend through the filter body 35'. On the other hand, the liquid tubes 51' extend through the filter body 35' to the aspiration side of the circulating pump 23.

In the arrangement of FIG. 1, for separation of light oil from the liquid engaged in the shaft, two collecting troughs 60 and 61 are provided. One collecting trough 60 is located at the upper edge of the loading region 28 above the hollow cylindrical body 19 and is ring-shaped. The other collecting trough 61 is arranged in the tubular body region 54 at a distance from the separating wall 42. Both collecting troughs have in their bottoms openings 62 through which heavy carrier fluid can be discharged. Suction conduits 64 and 65 for aspiration of the separated light oil open in the collecting troughs 60 and 61 and lead to the suction pumps 63.

The arrangement of FIG. 2 is formed for separation of heavy oils. For this purpose it is provided with a ring-shaped collecting trough 66 at the deepest point of the tubular body region 54, directly above the separating wall 42. The collecting trough 66 has a closed body, and the liquid tube 51 extends through the body. The heavy oil which settles in the collecting trough 66 is pumped out by a suction pump 63 through a suction conduit 67. The arrangement is additionally provided with vibration generators 70 arranged in the region of the upwardly transported liquid above the circulating pump 23 and mounted on the nozzle body 26. The vibration generators can be formed, for example, as disclosed in U.S. Pat. Nos. 5,147,535 and 4,045,336. Due the vibrations produced by it in the upwardly transported liquid, the separation of the heavy oil fraction from the carrier liquid especially ground water or the treatment liquid supplied through the ring conduit 56 is improved. As in the arrangement of FIG. 1, also here gas bubbles raising from the nozzle body 26 act as a carrier for oil particles which subsequently are returned to the filter bodies 35.

The arrangement of FIG. 3 is also formed for the separation of heavy oils. The tubular body 15 is closed under the tubular body region 54 to a collecting trough 68. A suction pump 63 is located on its deepest point for pumping out of the heavy oil collected in it through the conduit 69 which is guided outside the tubular body 15. A second collecting trough 71 is formed above the central wall 24 around the suction pump 23. The heavy oil which is collected there is removed through a suction conduit 72 again by a special suction pump 63. In this arrangement also as in the embodiment of FIG. 2 the vibration generator 70 can be provided, for example on the nozzle body 26 or also in the tubular body region 52 at the lower side of the separating wall 42. The vibration generators can also be arranged so that they also act on the bordering ground or rock formations.

Figure 8:
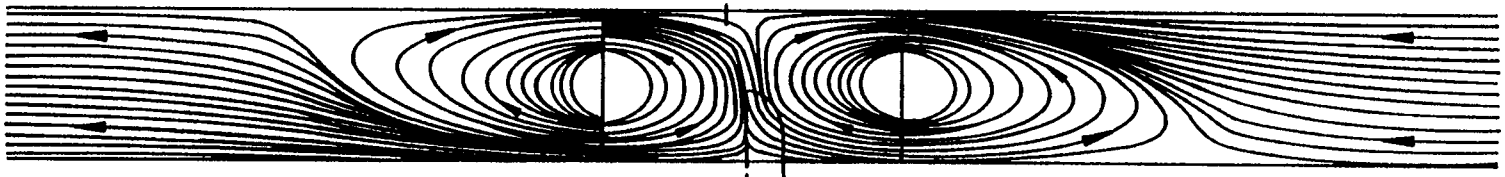
Figure 9:
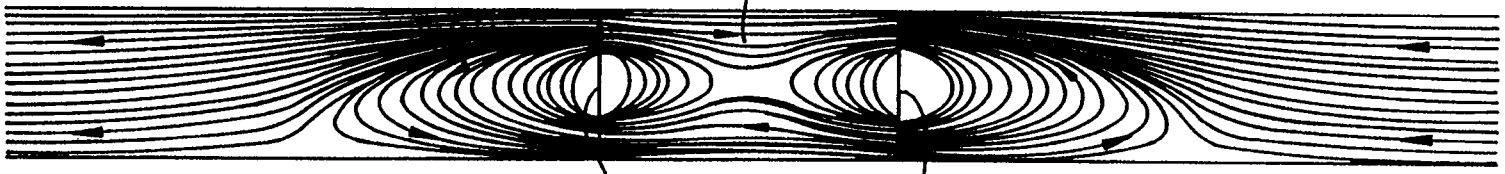

Due to the adjacent arrangement of several bore shafts which are designed so that the fluid circulation courses extending from them touch or intersect one another, the region with different flow velocities can be provided and for example high flow densities can be produced in the ground regions of interest. FIGS. 4–9 show computer produced flow diagrams formed from secured measuring data. They represent two adjacent well shafts 10', 10'' identified with a vertical line and formed in accordance with FIGS. 1–3 wherein inside one of the Figures the ground water flow from right to left can be obtained. Therefore by the selection of the opposite distances of the well shafts and/or by the intensity of the liquid circulation drive in the shafts, and/or the selected circulating direction in the shafts, different flow profiles can be obtained. Regions 80 with substantially increased flow density (identified in FIGS. 4–6), flow displacements also with pronounced vertical components (for example region 81 in FIG. 8) and with counterflow regions 82 (FIGS. 5 and 9) are illustrated. Inner circulation in the region of individual well shafts and outer circulation (over the counterflow region 82 for example) between neighboring well shafts can be distinguished. The flow profiles can be changed and distorted in each passing direction by the formation of additional openings without drive device and by vanes or in other words the formation of resistance-free flow paths. In FIG. 8 is such a transverse passage 83 shown, which contributes to formation of desired vertical flow in a ram point of the flow profile. The flow profile can be additionally influenced also by a partial flow withdrawal of the liquid in a well shaft with circulating drive, while to the contrary in the neighboring well shafts there is no such partial flow withdrawal.

It will be understood that each of the elements described above, or two or more together, may also find a useful application in other types of methods and arrangements differing from the types described above.

While the invention has been illustrated and described as embodied in a method of and arrangement for obtaining liquids and/or gases from ground or rock formations, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A method of obtaining liquids and/or gases contained in ground or rock formations, contaminants or useful substances, especially oils, comprising the steps of arranging at least one shaft provided with a casing having vertically spaced permeable and impermeable wall regions in a corresponding region;

forming a negative pressure in the shaft provided with the casing having the vertically spaced permeable and impermeable wall regions, and thereby producing a circulation of an available or introduced liquid from ground or rock formations through a first permeable wall region into the shaft, further in an axial direction of the shaft and then through a second permeable wall region back into the ground or rock formations;

aspirating gases entrained in the circulation of liquid by a negative pressure device of the shaft and/or from a liquid separated in the shaft such as for example oil by means of liquid probes through a filter or another separator outwardly; and providing a second such shaft which are arranged near the first mentioned shaft so that the circulations of liquid in the shafts touch or intersect one another.

2. A method as defined in claim 1; and further comprising the step of supplying tensides into the circulation of liquid through conduits extending in the shafts.

3. A method as defined in claim 1; and further comprising the step of arranging in the shaft at least one device for producing vibrations in the ground or rock formations and/or in the liquid which flows through an interior of the shaft.

4. A method as defined in claim 3; and further comprising the step of orienting the produced vibrations along the shaft.

5. A method as defined in claim 1; and further comprising the step of providing a plurality of low resistance flow paths for the liquid in addition to said shafts.

6. A method as defined in claim 5, wherein said low resistance flow paths are formed as formations selected from the group consisting of an opening, a trench and a channel.

7. A method as defined in claim 5, wherein said low resistance flow paths are formed in a ram point of a flow profile produced in the ground.

8. A method as defined in claim 5; and further comprising the step of producing different circulation directions in said shafts.

9. A method as defined in claim 1; and further comprising the step of withdrawing a partial flow from the circulating of fluid in the shaft.

10. A method of obtaining liquids and/or gases contained in ground or rock formations, contaminants or useful substances, particularly oils, comprising the steps of arranging at least one shaft in a corresponding region;

subdividing the shaft by a transverse separation wall into an upper and a lower shaft region each having a substantially vertical fluid permeable wall;

arranging a flow passage extending through the separating wall and provided with a circulating pump for producing a circulation of an available or introduced liquid from the ground or rock formations through one or both shaft regions into the shaft, further through the flow passage into another of the shaft regions, then from there back into the ground or rock formation;

collecting the obtained liquid and/or gas in the shaft regions and aspiration of the liquids by means of probes through a filter or another separator; and providing a second such shaft which are arranged near the first mentioned shaft so that the circulations of liquid in the shafts touch or intersect one another.

11. A method as defined in claim 10; and further comprising the step of supplying tensides into the circulation of liquid through conduits guiding in the shafts.

12. A method as defined in claim 10; and further comprising the step of arranging in the shaft at least one device for producing vibrations in the ground or rock formations and/or in the liquid which flows through an interior of the shaft.

13. A method as defined in claim 12; and further comprising the step of orienting the produced vibrations along the shaft.

14. A method as defined in claim 10; and further comprising the step of providing a second shaft or a second bore hole which are arranged near the first mentioned shaft or bore hole so that the circulation of liquid in them touches or intersects one another.

15. A method as defined in claim 10; and further comprising the step of providing a plurality of low resistance flow paths in addition to said shafts.

16. A method as defined in claim 15, wherein said low resistance flow paths are formed as formations selected from the group consisting of an opening, a trench and a channel.

17. A method as defined in claim 15, wherein said low resistance flow paths are formed in a ram point of a flow profile produced in the ground.

18. A method as defined in claim 15; and further comprising the step of producing different circulation directions in said shafts.

19. A method as defined in claim 10; and further comprising the step of withdrawing a partial flow of liquid from the circulating of fluid in the shaft.

20. An arrangement of obtaining liquids and/or gases contained in ground or rock formation, such as contaminants or useful substances, in particular oils, the arrangement comprising a shaft extending to a corresponding region of ground or gas formation; a transverse separating wall separating said shaft into shaft regions which are vertically spaced and sealed from one another; a substantially vertical permeable shaft wall for aspiration of liquids or gases from a surrounding area and for further introducing the liquids or gases into the surrounding area, said separating wall having an opening which forms a part of a flow path; a pump and a filter arranged so that said flow path leads through said pump and said filter; a shaft insert arranged in said shaft; a tube extending through said opening and said separating wall and forming a part of said shaft insert, said pump being formed as a circulating pump arranged on said shaft insert and transporting the liquid or gas through said permeable shaft wall; an upwardly open collecting chamber arranged on said shaft insert above said separating wall at least one point of the flow path provided for a liquid which has a different specific density from that of other a flow medium flowing through said shaft; an aspirating conduit which opens in said collecting chamber; and an additional shaft which opens in said collecting chamber; and an additional shaft which is arranged near the first mentioned shaft so that the circulations of liquid in the shafts touch or intersect one another.

21. An arrangement as defined in claim 20, wherein said shaft insert is formed as a nozzle body and has a gas chamber and is limited by a nozzle wall so that due to production of a negative pressure a gas is supplied in said nozzle body.

22. An arrangement as defined in claim 20, wherein said upwardly open collecting chamber has a chamber bottom provided with openings for withdrawing a liquid fraction with smaller specific density than that of the other flow medium.

23. An arrangement as defined in claim 20, wherein said upwardly open collecting chamber is arranged immediately above said separating wall for withdrawing a liquid fraction with a greater specific weight than that of the other flow medium.

24. An arrangement as defined in claim 20, wherein said shaft insert has a hollow body which is upwardly open and which has downwardly at least one inlet opening for the flow medium; and further comprising a nozzle body provided with a nozzle wall and arranged in said hollow body so that the flow path extends through said nozzle body.

25. An arrangement as defined in claim 21; and further comprising a gas filter arranged so that due to the formation of negative pressure the gas aspirated from the shaft passes through said gas filter and at least partially again back into said shaft.

26. An arrangement as defined in claim 25; and further comprising a heating aggregate arranged so that the aspirated gas is supplied additionally through said heating aggregate.

27. An arrangement as defined in claim 25; and further comprising a cooling aggregate arranged so that the aspirated gas is supplied additionally through said cooling aggregate.

28. An arrangement as defined in claim 20; and further comprising an additional upwardly open collecting chamber arranged in the shaft under said separating wall.

* * * * *

UNITED STATES PATENT AND TRADEMARK OFFICE

CERTIFICATE OF CORRECTION

PATENT NO. : 5,345,655

DATED : September 13, 1994

INVENTOR(S) : Bruno BERNHARDT

It is certified that error appears in the above-identified patent and that said Letters Patent is hereby corrected as shown below:

On Title Page, item

[21] Appl. No. should read --014,414--

Signed and Sealed this

Twenty-second Day of November, 1994

Attest:

Bruce Lehman

BRUCE LEHMAN

Attesting Officer

Commissioner of Patents and Trademarks